US008040075B2

(12) United States Patent
Horino

(10) Patent No.: US 8,040,075 B2
(45) Date of Patent: Oct. 18, 2011

(54) ILLUMINATION APPARATUS FOR ADJUSTING COLOR TEMPERATURE AND BRIGHTNESS AND ILLUMINATION SYSTEM INCLUDING THE SAME

(75) Inventor: Mamoru Horino, Gyunggi-do (KR)

(73) Assignee: Samsung LED Co., Ltd., Gyunggi-Do (KR)

( * ) Notice: Subject to any disclaimer, the term of this patent is extended or adjusted under 35 U.S.C. 154(b) by 333 days.

(21) Appl. No.: 12/266,704

(22) Filed: Nov. 7, 2008

(65) Prior Publication Data

US 2010/0007292 A1 Jan. 14, 2010

(30) Foreign Application Priority Data

Jul. 8, 2008 (KR) ..... 10-2008-0066144

(51) Int. Cl.
*H05B 37/02* (2006.01)

(52) U.S. Cl. ..... 315/291; 315/312

(58) Field of Classification Search ..... 315/291, 315/312, 360, 113, 118, 224
See application file for complete search history.

(56) References Cited

U.S. PATENT DOCUMENTS

| | | | | |
|---|---|---|---|---|
| 6,788,011 | B2 | 9/2004 | Mueller et al. | |
| 2008/0030153 | A1* | 2/2008 | Mizuno | 315/360 |
| 2010/0148703 | A1* | 6/2010 | Mizuno | 315/312 |

FOREIGN PATENT DOCUMENTS

| | | |
|---|---|---|
| JP | 07-211463 | 8/1995 |
| JP | 08-064369 | 3/1996 |

OTHER PUBLICATIONS

Japanese Office Action, w/ English translation thereof, issued in Japanese Patent Application No. JP 2008-303065 dated Jun. 14, 2011.

* cited by examiner

*Primary Examiner* — Daniel D Chang
(74) *Attorney, Agent, or Firm* — McDermott Will & Emery LLP

(57) ABSTRACT

Disclosed are an illumination apparatus for adjusting a color temperature and brightness, which can determine duties of pulse width modulation (PWM) control pulses for driving two light sources having different color temperatures, and an illumination system including the same. The illumination apparatus includes first and second light source units emitting light of different color temperatures, first and second pulse width modulation (PWM) driving units respectively driving the first and second light source units by a PWM control method, and a duty control unit controlling respective duties of PWM control pulses of the first and second PWM driving units according to a color-temperature set value and a brightness set value input from the outside. The duty control unit controls the duties such that the color-temperature set value is reflected in the respective duties of the PWM control pulses of the first and second PWM driving units in a complementary relation.

4 Claims, 2 Drawing Sheets

ILLUMINATION APPARATUS FOR ADJUSTING COLOR TEMPERATURE AND BRIGHTNESS AND ILLUMINATION SYSTEM INCLUDING THE SAME

CROSS-REFERENCE TO RELATED APPLICATIONS

This application claims the priority of Korean Patent Application No. 2008-66144 filed on Jul. 8, 2008, in the Korean Intellectual Property Office, the disclosure of which is incorporated herein by reference.

BACKGROUND OF THE INVENTION

1. Field of the Invention

The present invention relates to an illumination apparatus and an illumination system, and more particularly, to an illumination apparatus for adjusting a color temperature and brightness, which can adjust a color temperature and brightness by determining a duty of a pulse width modulation (PWM) control pulse based on a color-temperature set value and a brightness set value, and an illumination system including the same.

2. Description of the Related Art

In general, a related art illumination apparatus includes two light source units that emit white light having different color temperatures. The light source units may be driven under pulse width modulation (PWM) control. The duty control of the PWM control pulse is necessary for adjusting the color temperature and brightness of light emitted from the lighting apparatus.

In a related art illumination apparatus, the duty is adjusted by repetitively inputting a command for increasing/decreasing a duty of a PWM control pulse for driving each color light source by predetermined steps. For this reason, it is impossible to set a desired color temperature and brightness at a time and to adjust the brightness while maintaining the color temperature or adjust the color temperature while maintaining the brightness. Also, the related art illumination apparatus has the following limitations. If an error occurs in transmission of the command for increasing/decreasing the duty of the PWM control pulse for driving each color light source, a difference is caused between a duty input by a user and a duty being actually applied. In addition, it is almost impossible to correct this difference.

SUMMARY OF THE INVENTION

An aspect of the present invention provides an illumination apparatus for adjusting a color temperature and brightness, which can determine duties of pulse width modulation (PWM) control pulses for driving two light sources having different color temperatures, and an illumination system including the same.

According to an aspect of the present invention, there is provided an illumination apparatus for adjusting a color temperature and brightness, including: first and second light source units emitting light of different color temperatures; first and second pulse width modulation (PWM) driving units respectively driving the first and second light source units by a PWM control method; and a duty control unit controlling respective duties of PWM control pulses of the first and second PWM driving units according to a color-temperature set value and a brightness set value input from the outside. The duty control unit controls the duties such that the color-temperature set value is reflected in the respective duties of the PWM control pulses of the first and second PWM driving units in a complementary relation.

The duties of the PWM control pulses of the first and second PWM driving units may be respectively determined by the following equations 1 and 2:

$$D_1 = \frac{X \times \left(\frac{Y}{N}\right)}{M} \quad \text{Equation 1}$$

$$D_2 = \frac{(N - X) \times \left(\frac{Y}{N}\right)}{M} \quad \text{Equation 2}$$

where $D_1$ and $D_2$ respectively represent duties of the first and second PWM driving units, X represents the color-temperature set value, Y represents the brightness set value, M represents the number of slots of the first and second PWM driving units, and N represents a constant where $0 \leqq X \leqq N$, and $0 \leqq X \leqq N$.

According to another aspect of the present invention, there is provided an illuminating system including: a controller receiving a color-temperature setting and a brightness setting, generating a color-temperature set value and a brightness set value corresponding to the color-temperature setting and the brightness setting, and transmitting the color-temperature set value and the brightness set value; and an illumination apparatus including: a reception unit receiving the color-temperature set value and the brightness set value transmitted from the controller; first and second light source units emitting light of different color temperatures; first and second pulse width modulation (PWM) driving units respectively driving the first and second light source units by a PWM control method; and a duty control unit controlling respective duties of PWM control pulses of the first and second PWM driving units according to the color-temperature set value and the brightness set value. The duty control unit controls the duties such that the color-temperature set value is reflected in the respective duties of the PWM control pulses of the first and second PWM driving units in a complementary relation.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. In the figures, the dimensions and the shapes of elements are exaggerated for clarity of illustration.

Figure 1:
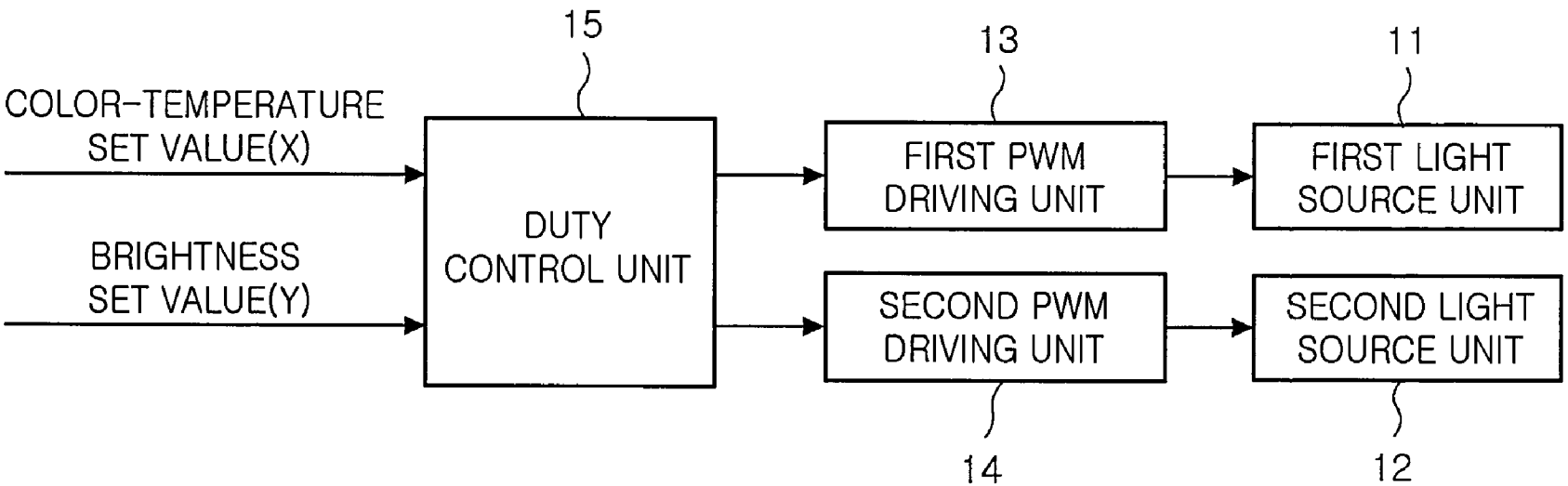
FIG. 1 is a block diagram of an illumination apparatus for adjusting a color temperature and brightness, according to an exemplary embodiment of the present invention.

FIG. 1 is a block diagram of an illuminating apparatus for adjusting a color temperature and brightness, according to an exemplary embodiment of the present invention.

As shown in FIG. 1, the illumination apparatus for adjusting a color temperature and brightness according to this embodiment includes first and second light source units 11 and 12 emitting light having different color temperatures; first and second pulse width modulation (PWM) driving units 13 and 14 respectively driving the first and second light source units 11 and 12 by a PWM control method; and a duty control unit 15 controlling respective duties of PWM control pulses of the first and second PWM driving units 13 and 14 according to a color-temperature set value (X) and a brightness set value (Y) input from the outside.

The first and second light source units 11 and 12 each may include a light emitting diode (LED) or an LED array emitting white light having different color temperatures. For example, the first light source unit 11 may employ a white LED having a color temperature of about 5000 K, and the second light source unit 12 may employ a white LED having a color temperature of about 2600 K. Such color temperatures are disclosed as mere examples. In order to adjust the color temperature of the illumination within a wide range, two types of white LEDs having the greatest possible difference in the color temperature may be used.

The first and second PWM driving units 13 and 14 drive the first and second light source units 11 and 12 by using a general PWM control method, respectively. The first and second PWM driving units 13 and 14 receive PWM control pulses for PWM control from the duty control unit 15.

The duty control unit 15 receives a color-temperature set value (X) and a brightness set value (Y) from the outside, and generates PWM control pulses used for the PWM control of the first and second PWM driving units 13 and 14 so that the first and second light source units 11 and 12 can emit light corresponding to the received color-temperature set value (X) and the brightness set value (Y). That is, the duty control unit 15 suitably determines duties of the PWM control pulses used for the PWM control of the first and second PWM driving units 13 and 14, thereby allowing the first and second light source units 11 and 12 to emit light corresponding to the color-temperature set value (X) and the brightness set value (Y).

Particularly, the duty control unit 15 generates respective duties for the first and second PWM driving units 13 and 14, each of which can reflect the color-temperature set value (X) and the brightness set value (Y) at the same time. For example, the duty control unit 15 may determine the respective duties of the PWM control pulses being provided to the first and second PWM driving units 13 and 14 by Equations 1 and 2 below, respectively:

$$D_1 = \frac{X \times \left(\frac{Y}{N}\right)}{M} \quad \text{Equation 1}$$

$$D_2 = \frac{(N - X) \times \left(\frac{Y}{N}\right)}{M} \quad \text{Equation 2}$$

where D1 and D2 respectively represent duties of the first and second PWM driving units 13 and 14, X represents the color-temperature set value, Y represents the brightness set value, M represents the number of PWM slots of the first and second PWM driving units 13 and 14, and N is a constant of $0 \leqq X \leqq N$, $0 \leqq Y \leqq N$.

As can be seen from Equations 1 and 2 above, the duty control unit 15 reflects the same brightness set value (Y) while reflecting the color-temperature set value (X) in complementary relation in the respective duties of the PWM control pulses being provided to the first and second PWM driving units 13 and 14. Since the duty control is made in the aforementioned manner according to the present invention, the color temperature of the illumination can be adjusted in a state where the entire brightness of the two light source units 11 and 12 is maintained constant. Also, just the brightness can be adjusted while the color temperature is maintained.

The illumination can be changed to achieve a desired color or brightness with only one input of set values, compared to a related lighting control method using a command for directly increasing/decreasing a PWM duty of each light source.

The duty control unit 15 may be implemented as a central processing unit (CPU) configured to process an algorithm programmed to generate a PWM control pulse of each of the PWM driving units 13 and 14 based on the color-temperature set value (X) and the brightness set value (Y) being input.

Figure 2:
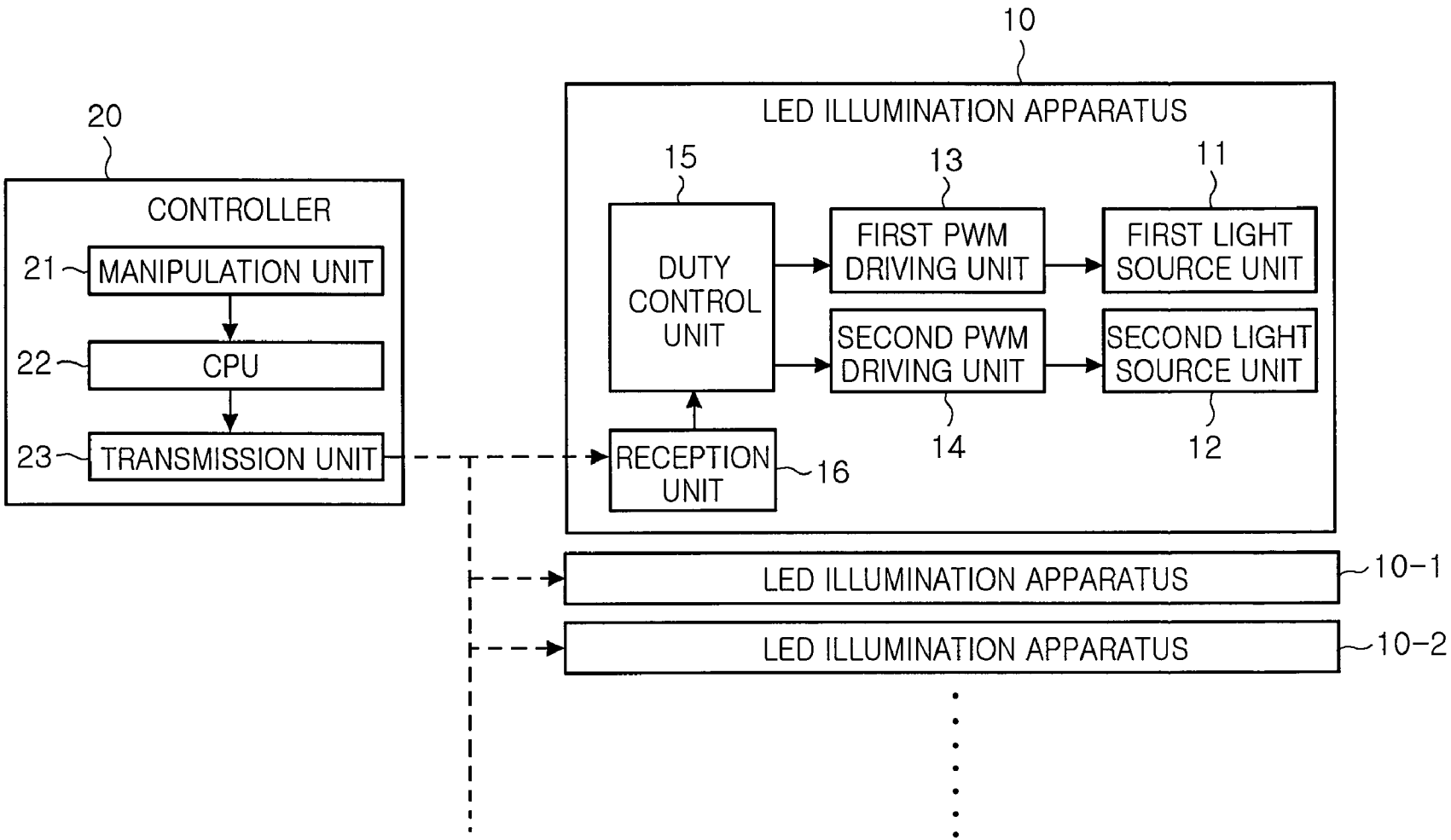
FIG. 2 is a block diagram of an illumination system using an illumination apparatus for adjusting a color temperature and brightness, according to an exemplary embodiment of the present invention.

FIG. 2 is a block diagram of an example of an illumination system employing the illumination apparatus for a color temperature and brightness, according to an exemplary embodiment of the present invention.

As shown in FIG. 2, the illumination system employing an illumination apparatus for adjusting a color temperature and brightness, according to this embodiment may include an illumination apparatus 10 of the previous embodiment, and a controller 20 for user input.

The illumination apparatus 10 of the illumination system of FIG. 2 may further include a reception unit 16 for receiving a control signal from the controller 20, in addition to the configuration of the illumination apparatus described above. The reception unit 16 may be implemented by adopting a wireless reception method using, e.g., infrared rays or radio frequencies, or a wired reception method.

The controller 20 may include a manipulation unit 21, a CPU 22, and a transmission unit 23. The manipulation unit 21 allows user's manipulation for direct input of a color-temperature setting and a brightness setting. The CPU 22 generates a color-temperature set value and a brightness set value corresponding to the user's input at the manipulation unit 21. The transmission unit 23 transmits the color-temperature set value and the brightness set value generated at the CPU 22 to the illumination apparatus 10.

The illumination system may control a plurality of illumination apparatuses 10, 10-1 and 10-2 by using one controller 20. In this case, a method may be used in which a signal transmitted from the transmission unit 23 contains information of a destination illumination apparatus, such as an address or the like.

In the illumination system, the CPU 22 included in the controller 20 serves to generate a color-temperature set value and a brightness set value corresponding to a user's manipulation, and the duty control unit 15 implemented as another CPU in the illumination apparatus 10 serves to determine a PWM duty based on the color-temperature set value and the brightness set value. Therefore, those CPUs may be implemented as a low-level CPU which is relatively cheap.

Also, since the illumination system generates the color-temperature set value and the brightness set value directly from the controller 20 and send them to the illumination apparatus, the communication frequency is reduced and thus reliability of the communication can be improved, compared to the related art method of simply repetitively inputting a command for increasing/decreasing the PWM duty. Even if an error occurs in communication, correct duty control can be performed with the next input.

According to the present invention, it is possible to adjust the color temperature of the illumination while the entire brightness of the two light source units is maintained constant. It is also possible to adjust only the brightness in a state where the color temperature is maintained.

According to the present invention, the illumination can be changed to have a desired color or brightness with just one input of set values, compared to the related art illumination control method using a command for directly increasing/decreasing the PWM duty of each light source.

According to the present invention, a color-temperature set value and a brightness set value are generated directly from the controller and sent to the illumination apparatus. Thus, the communication frequency is reduced and thus reliability of the communication can be improved, compared to a related art method of simply repetitively inputting a command for increasing/decreasing the PWM duty. Thus, even if an error occurs in the communication, correct duty control can be preformed with the next input.

While the present invention has been shown and described in connection with the exemplary embodiments, it will be apparent to those skilled in the art that modifications and variations can be made without departing from the spirit and scope of the invention as defined by the appended claims.

What is claimed is:

1. An illumination apparatus for adjusting a color temperature and brightness, the illumination apparatus comprising:

first and second light source units emitting light of different color temperatures;

first and second pulse width modulation (PWM) driving units respectively driving the first and second light source units by a PWM control method; and a duty control unit controlling respective duties of PWM control pulses of the first and second PWM driving units according to a color-temperature set value and a brightness set value input from the outside, wherein the duty control unit controls the duties such that the color-temperature set value is reflected in the respective duties of the PWM control pulses of the first and second PWM driving units in a complementary relation.

2. The illumination apparatus of claim 1, wherein the duties of the PWM control pulses of the first and second PWM driving units are respectively determined by the following equations 1 and 2:

$$D_1 = \frac{X \times \left(\frac{Y}{N}\right)}{M} \quad \text{Equation 1}$$

-continued $$D_2 = \frac{(N - X) \times \left(\frac{Y}{N}\right)}{M} \quad \text{Equation 2}$$

where $D_1$ and $D_2$ respectively represent duties of the first and second PWM driving units, X represents the color-temperature set value, Y represents the brightness set value, M represents the number of slots of the first and second PWM driving units, and N represents a constant where $0 \leqq X \leqq N$, and $0 \leqq X \leqq N$.

3. An illuminating system comprising:

a controller receiving a color-temperature setting and a brightness setting, generating a color-temperature set value and a brightness set value corresponding to the color-temperature setting and the brightness setting, and transmitting the color-temperature set value and the brightness set value; and an illumination apparatus comprising:

a reception unit receiving the color-temperature set value and the brightness set value transmitted from the controller;

first and second light source units emitting light of different color temperatures;

first and second pulse width modulation (PWM) driving units respectively driving the first and second light source units by a PWM control method; and a duty control unit controlling respective duties of PWM control pulses of the first and second PWM driving units according to the color-temperature set value and the brightness set value, wherein the duty control unit controls the duties such that the color-temperature set value is reflected in the respective duties of the PWM control pulses of the first and second PWM driving units in a complementary relation.

4. The illumination system of claim 3, wherein the duties of the PWM control pulses of the first and second PWM driving units are respectively determined by the following equations 1 and 2:

$$D_1 = \frac{X \times \left(\frac{Y}{N}\right)}{M} \quad \text{Equation 1}$$

$$D_2 = \frac{(N - X) \times \left(\frac{Y}{N}\right)}{M} \quad \text{Equation 2}$$

where $D_1$ and $D_2$ respectively represent duties of the first and second PWM driving units, X represents the color-temperature set value, Y represents the brightness set value, M represents the number of slots of the first and second PWM driving units, and N represents a constant where $0 \leqq X \leqq N$, and $0 \leqq X \leqq N$.

* * * * *